US009643769B2

(12) United States Patent
Chou et al.

(10) Patent No.: US 9,643,769 B2
(45) Date of Patent: May 9, 2017

(54) STORAGE BOX WITH SYNCHRONOUS OPENING/LIFTING MECHANISM

(71) Applicants: TSAE SHENG INTERNATIONAL CO., LTD., New Taipei (TW); Ming-Chuan Chou, New Taipei (TW)

(72) Inventors: Ming-Chuan Chou, New Taipei (TW); Tzu-Yen Chou, New Taipei (TW); Tzu-Lin Chou, New Taipei (TW); Chao-Yi Chen, New Taipei (TW); Tsung Hwa Yang, New Taipei (TW)

(73) Assignees: TSAE SHENG INTERNATIONAL CO., LTD., New Taipei (TW); Ming-Chuan Chou, New Taipei (TW)

( * ) Notice: Subject to any disclaimer, the term of this patent is extended or adjusted under 35 U.S.C. 154(b) by 489 days.

(21) Appl. No.: 14/146,879

(22) Filed: Jan. 3, 2014

(65) Prior Publication Data

US 2015/0151897 A1 Jun. 4, 2015

(30) Foreign Application Priority Data

Dec. 3, 2013 (TW) ..... 102144219 A

(51) Int. Cl.
*B65D 83/00* (2006.01)
*A45C 11/24* (2006.01)
*A45C 13/00* (2006.01)

(52) U.S. Cl.
CPC ..... *B65D 83/005* (2013.01); *A45C 11/24* (2013.01); *A45C 13/004* (2013.01)

(58) Field of Classification Search
CPC ..... B65D 83/005; B65D 83/0038; B65D 83/0005; B65D 83/0022; B65D 83/0044; A45C 11/24; A45C 13/004
USPC ..... 206/754, 583, 804, 250, 251, 751, 738, 206/755, 753, 756, 761, 774, 254, 758; 221/191, 192
See application file for complete search history.

(56) References Cited

U.S. PATENT DOCUMENTS 1,735,324 A * 11/1929 Enfant ..... A24F 15/12 206/251
2,132,339 A * 10/1938 Zipper ..... A24F 15/16 206/251
2,234,649 A * 3/1941 Meincke ..... A24F 15/16 206/251
4,641,748 A * 2/1987 Lewis ..... B65D 85/1036 206/251
7,565,969 B2 * 7/2009 He ..... B65D 7/06 206/249
2005/0211584 A1 * 9/2005 Danechi ..... B65D 43/164 206/361

(Continued)

*Primary Examiner* — Steven A. Reynolds
(74) *Attorney, Agent, or Firm* — WPAT, PC; Justin King; Douglas Hosack

(57) ABSTRACT

A storage box with synchronous opening and lifting mechanisms, having a shell unit, a storage unit arranged inside the shell unit for receiving the object, a lifting unit disposed at a position between the shell unit and the storage unit for lifting and lowering the object, and a synchronization unit disposed inside the shell unit and the storage unit for enabling the shell unit to perform a synchronous opening and closing operation. The lift unit is coupled to the synchronous unit for lifting an object in the storage unit during the synchronous opening operation of the shell unit and lowering the object during the synchronous closing operation of the shell unit.

13 Claims, 9 Drawing Sheets

(56) References Cited

U.S. PATENT DOCUMENTS

2010/0181227 A1* 7/2010 Tolkowsky ..... A45C 11/16
206/755

* cited by examiner

STORAGE BOX WITH SYNCHRONOUS OPENING/LIFTING MECHANISM

FIELD OF THE INVENTION

The present invention relates to a storage box with synchronous opening/lifting mechanism, and more particularly, to a box capable of enabling an object stored therein to be lifted while opening and lowed while closing.

BACKGROUND OF THE INVENTION

Generally, a conventional storage box available today is composed of a cover element and a box element, in which the box element is formed with an opening on top thereof for receiving an object into the box element therefrom; and the cover unit is disposed at a position corresponding to the opening for closing the box unit.

As it is common to have all kinds of storage boxes being used extensively in our daily life, those kinds of storage boxes are always operating in a monotonous manner, i.e. after removing its cover, an object that is sitting still in the box is revealed. In addition, for most storage boxes, the cover element is built independent to box element that the box element is not operating in synchronization with the operation of the cover element. Therefore, it is in need of an improved storage box that is fun to operate.

SUMMARY OF THE INVENTION

In view of the disadvantages of prior art, the primary object of the present invention is to provide a storage box with synchronous opening/lifting mechanism, capable of enabling an object stored therein to be lifted while opening and lowed while closing.

To achieve the above object, the present invention provides a storage box with synchronous opening/lifting mechanism, adapted for storing an object, which comprises: a shell unit; a storage unit, arranged inside the shell unit for receiving the object; a lifting unit, disposed at a position between the shell unit and the storage unit to be used for lifting and/or lowering the object; and a synchronization unit, disposed inside the shell unit and the storage unit for enabling the shell unit to perform a synchronous opening operation and/or a synchronous closing operation; wherein the lift unit is coupled to the synchronous unit for enabling the object stored in the storage unit to be lifted during the synchronous opening operation of the shell unit and lowed during the synchronous closing operation of the shell unit.

In an embodiment, the present invention provides an improved storage box that is capable of utilizing a built-in lifting unit to enable an object received therein to rise with the opening of the box and to lower with the closing of the box, and thus is fun to operate. Moreover, the improved storage box is enabled to utilize a built-in synchronization unit to enable a first shell of the box to move in synchronization with a second shell in opposite directions toward each other or away from each other.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
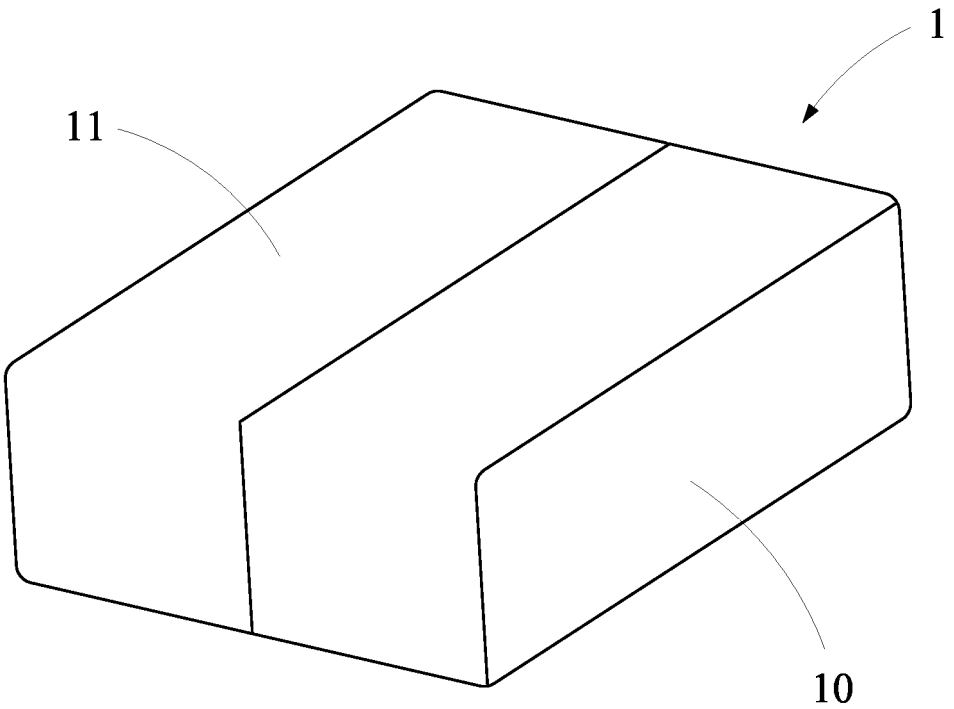
FIG. 1 is a schematic diagram showing a storage box with synchronous opening/lifting mechanism according to a first embodiment of the invention.
Figure 2:
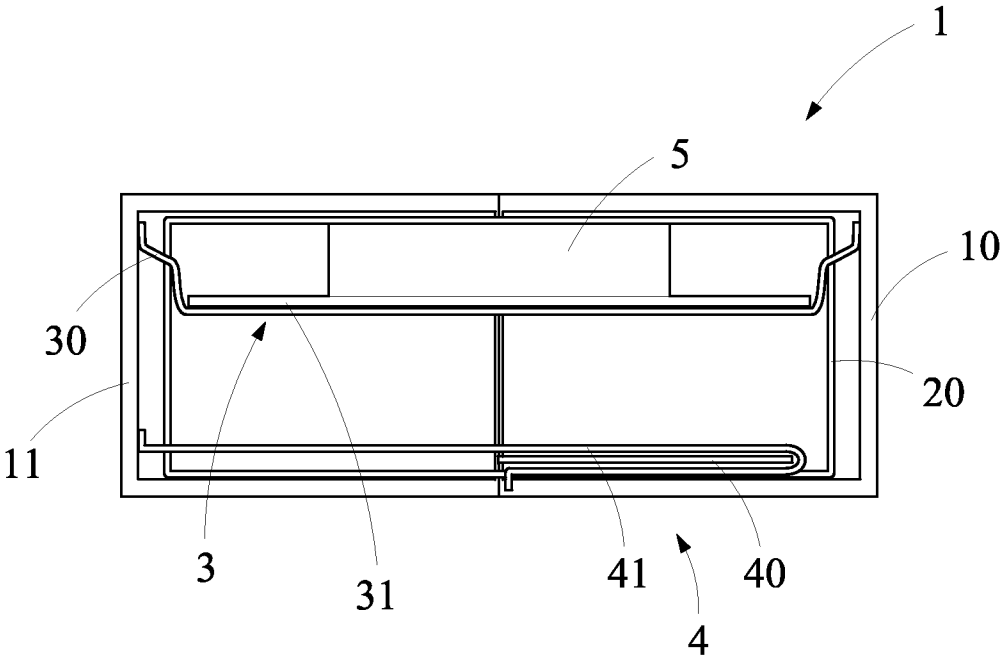
FIG. 2 is a cross-sectional view of a storage box of the first embodiment that is closed.
Figure 3:
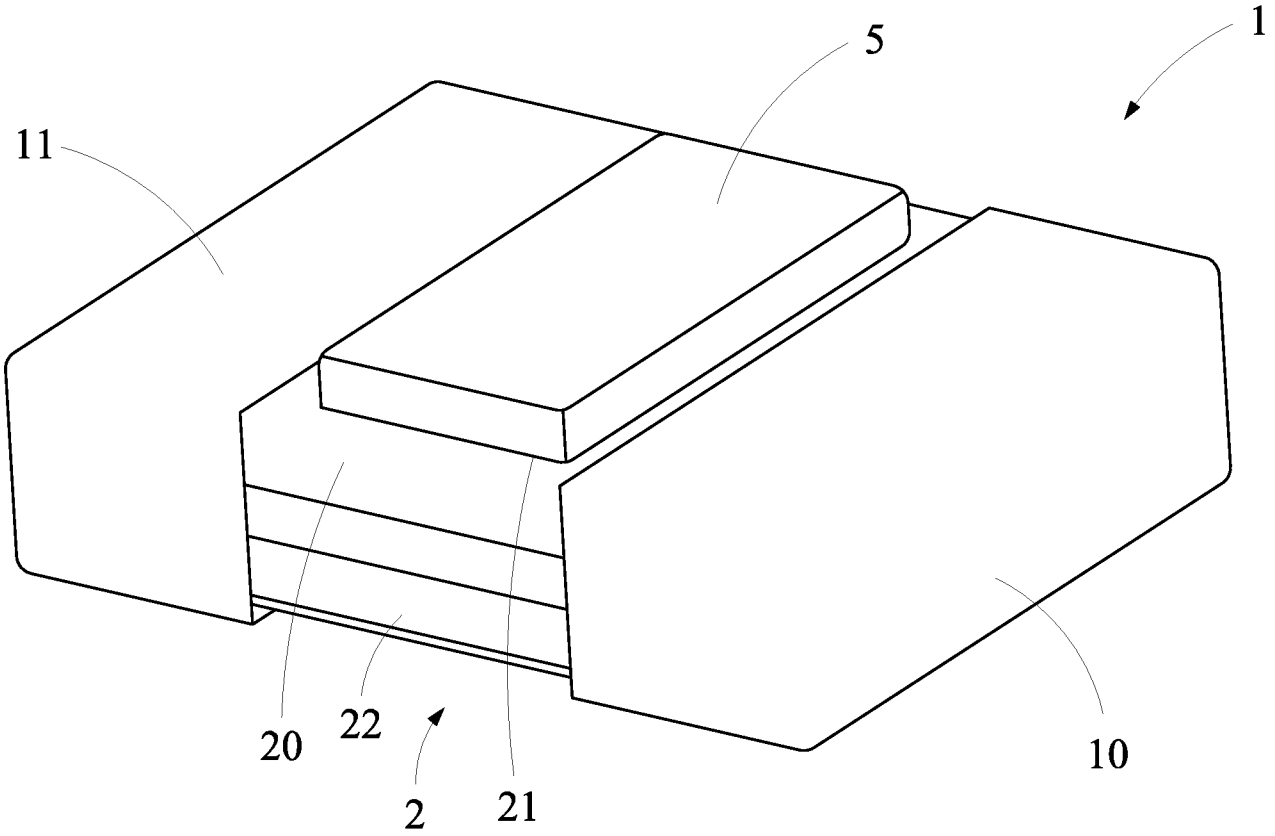
FIG. 3 is a three-dimensional view of a storage box of the first embodiment that is opened.

Please refer to FIG. 1. FIG. 2 and FIG. 3, which are schematic diagrams showing a storage box with synchronous opening/lifting mechanism according to a first embodiment of the invention. In this first embodiment, a storage box adapted for receiving an object 5 is disclosed, which comprises: a shell unit 1, a storage unit 2, a lifting unit 3 and a synchronization unit 4.

The shell unit 1 is configured with a rectangular first shell 10 and a rectangular second shell 11, in which the first shell 10 is formed with a first opening while the second shell 11 is formed with a second opening at a position corresponding to the first opening.

The storage unit 2 is disposed at a position between the first shell 10 and the second shell 11 and is configured with a receiving frame 20 and a drawer 22 in a manner that the receiving frame 20 is disposed at a position between the first shell 10 and the second shell 11, while allowing the drawer 22 that is formed with an inlet hole 21 at the top thereof to be arranged at a bottom end of the receiving frame 20.

The lifting unit 3 is disposed at a position between the first shell 10, the second shell 11 and the receiving frame 20, and is configured with a pulling part 30 and a supporting part 31 in a manner that one end of the pulling part 30 is coupled to an inner wall of the first shell 10 while allowing another end thereof to thread passing through the receiving frame 20 to be coupled to an inner wall of the second shell 11, and the supporting part 31 is disposed inside the receiving frame 20 at a position corresponding to the inlet hole 21 while coupling to the pulling part 30. In this embodiment, the pulling part 30 is composed of at least two flexible ropes or is substantially a flexible plate. In a condition when the pulling part 30 is made of a flexible plate, the pulling part 30 will be arranged under at the bottom of the supporting part 31, but when the pulling part 30 is made from ropes, it will be tie to the middle or the bottom of the supporting part 31.

As shown in FIG. 2, the synchronization unit 4 is disposed at a position between the first shell 10, the second shell 11 and the receiving frame 20, and is configured with a guiding part 40 and a synchronizing part 41 in a manner that the guiding part 40 is arranged at a position between the first shell 10 and the receiving frame 20, and the synchronizing part 41 is coupled to the first shell 10 at a position close to the first opening by one end thereof while allowing another end thereof to circle around the guiding part 40 and then coupled to an inner wall of the second shell 11. In this embodiment, the guiding part 40 can be a rod, a plate, or a pillar; and the synchronizing part 41 is a component selected from the group consisting of: a flexible rope and a flexible plate.

Figure 4:
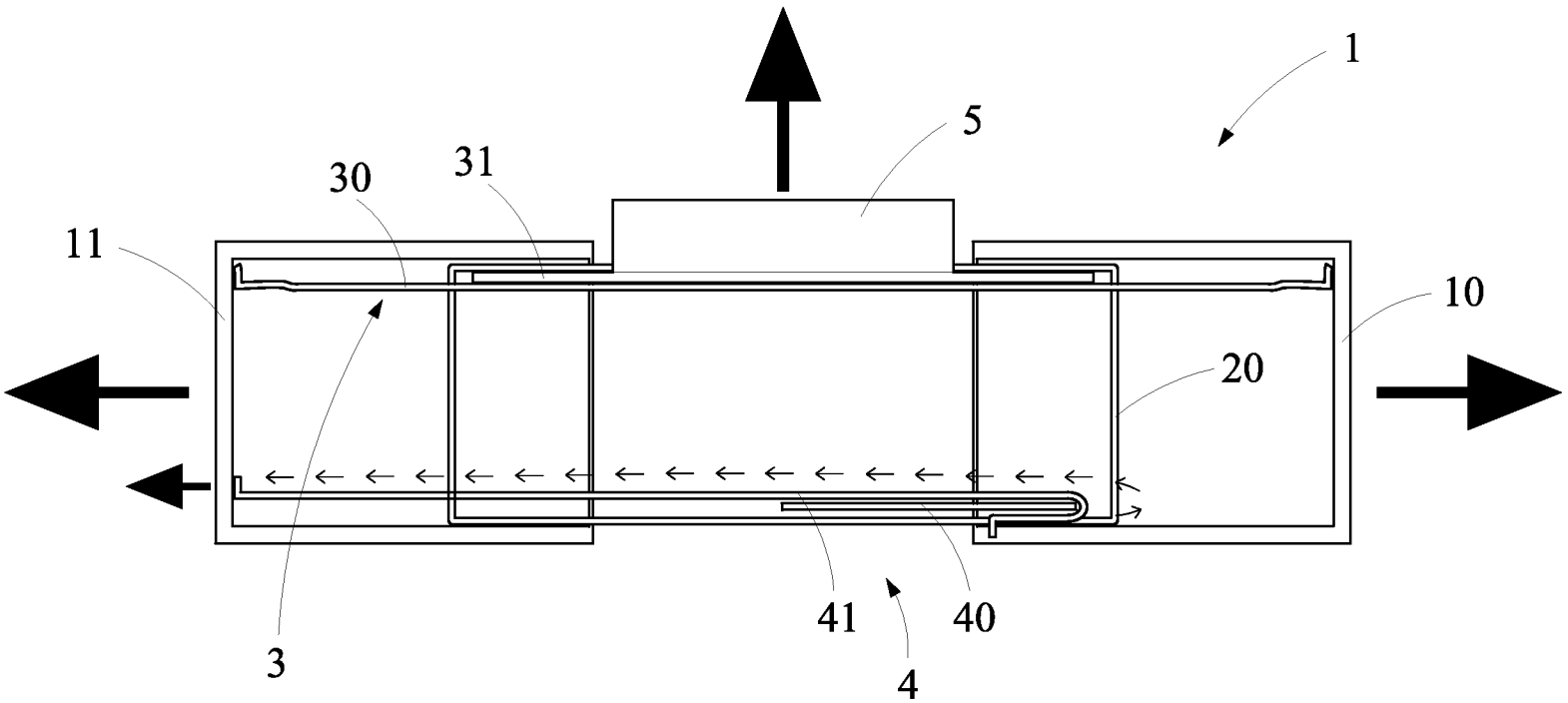
FIG. 4 is a cross-sectional view of a storage box of the first embodiment that is opened.

As shown in FIG. 4, when the second shell 11 is enabled to move in a direction away from the first shell 10, the synchronizing part 41 will be brought along to move in synchronization with the moving second shell 11 in a direction directed by the guiding part 40, and simultaneously the synchronizing part 41 is enabled to engage and push the guiding part 40 for bringing along the first shell 10 to move in a direction also away from the second shell 11 until a stretching limit of the synchronizing part 41 is reached, by that the shell unit 1 is opened.

Operationally, when the second shell 11 is enabled to move in a direction away from the first shell 10, the pulling part 30 will also be brought along to move in synchronization with the moving second shell 11, and consequently the pulling part 30 will be stretched further and further as the distance between the first shell 10 and the second shell 11 is getting bigger and bigger, while the supporting part 31 is being pulled by the stretching pulling part 30 to move in a direction toward the inlet hole 21. At the same time if there is an object 5 being placed on top of the supporting part 31, the object 5 will be raised to a position protruding outside the receiving frame 20.

Figure 5:
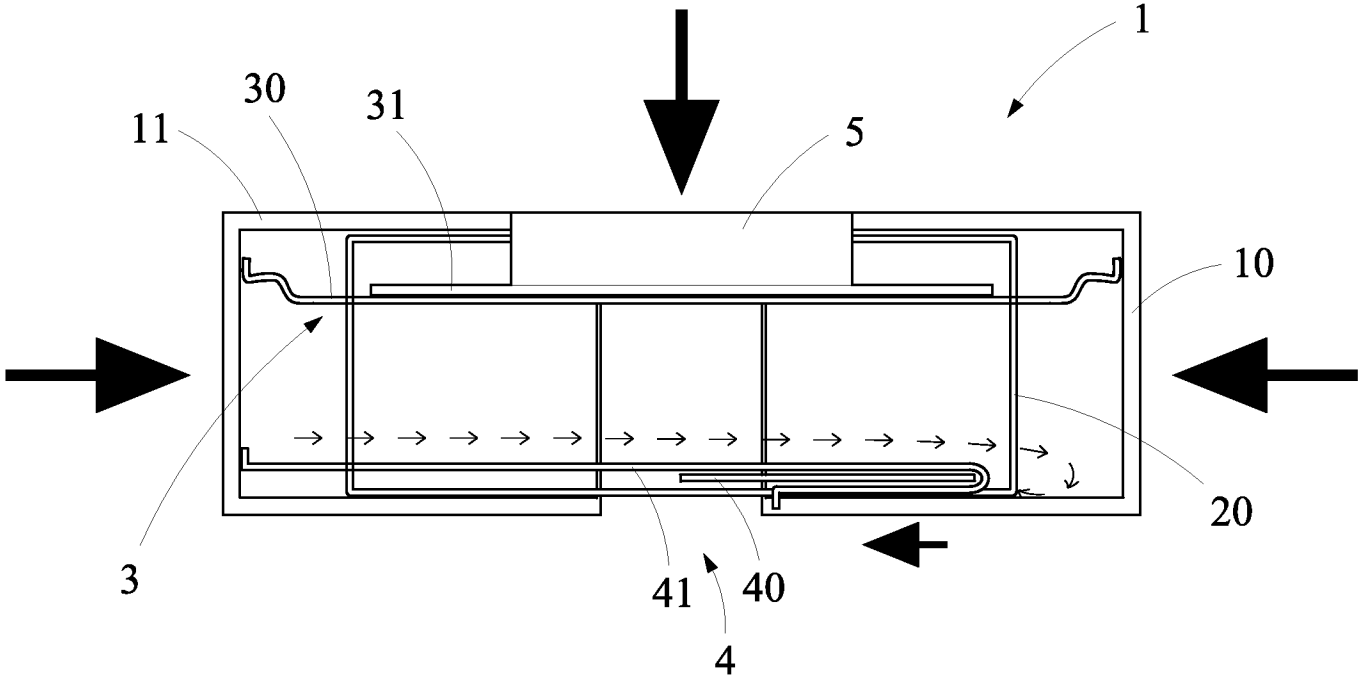
FIG. 5 is a cross-sectional view of a storage box of the first embodiment that is not fully closed.

As shown in FIG. 5, when the first shell 10 is enabled to move toward the second shell 11, the synchronizing part 41 will be brought along to move in synchronization with the moving first shell 10 for causing the second shell 11 to move toward the first shell 10 until the first shell 10 met with the second shell 11 and the shell unit 1 is closed.

Operationally, when the first shell 10 is enabled to move toward the second shell 11, the pulling part 30 will also be brought along to move in synchronization with the moving first shell 10, and consequently the pulling part 30 that was originally being stretched is relieved from being stretched and thus the object 5 at the top of the supporting part 31 will be lowered and retracted back inside the receiving frame 20.

In FIG. 3, the drawer 22 is provided for receiving the object 5 that is ready to be selectively pulled back into or pushed out of the receiving frame 20.

Figure 6:
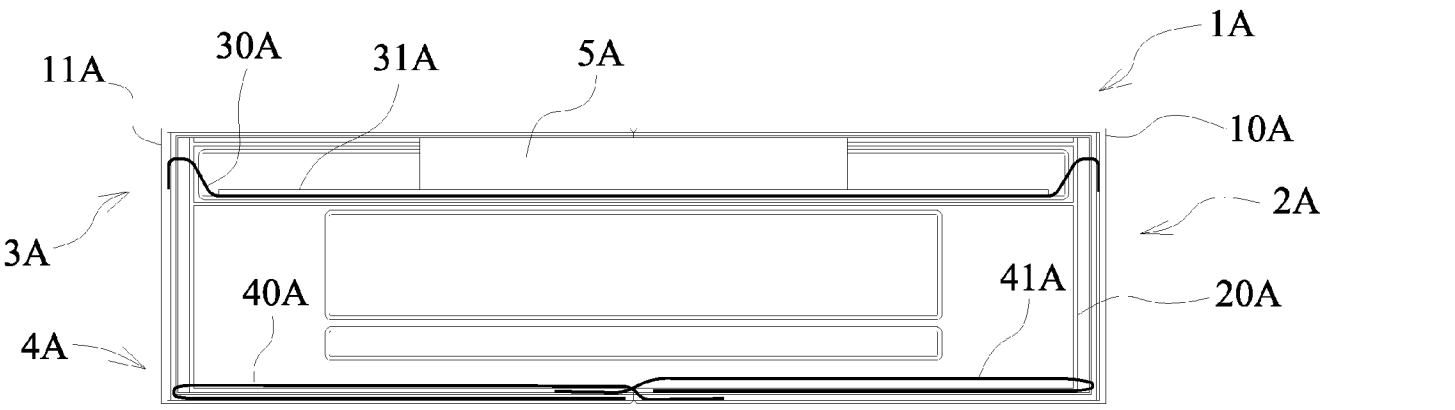
FIG. 6 is a cross-sectional view of a storage box with synchronous opening/lifting mechanism that is closed according to a second embodiment.
Figure 7:
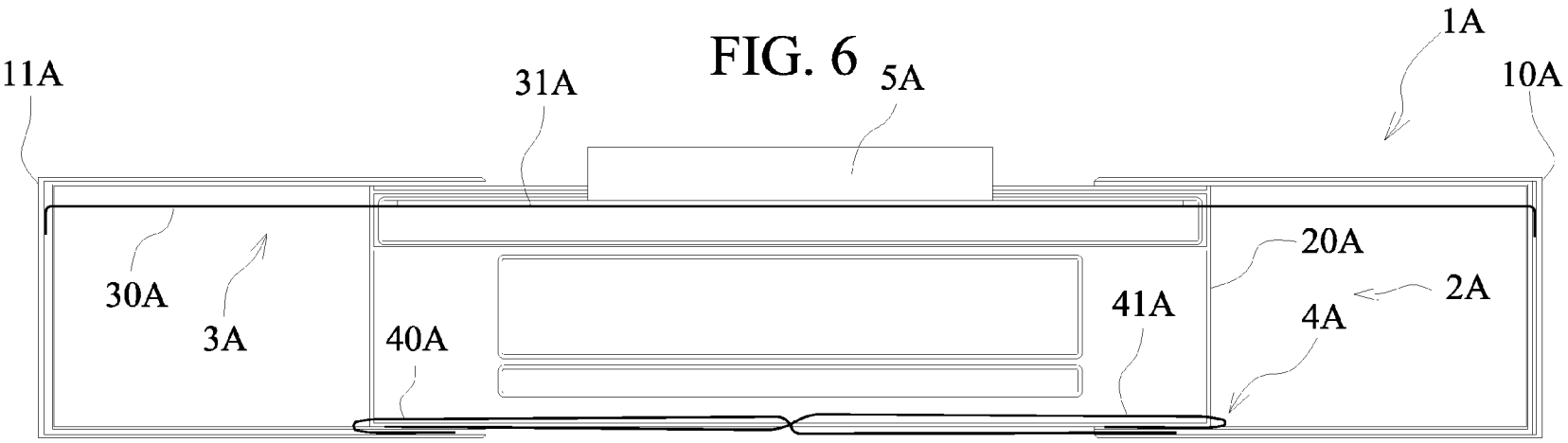
FIG. 7 is a three-dimensional view of a storage box of the second embodiment that is opened.

Please refer to FIG. 6 and FIG. 7, which are schematic diagrams showing a storage box with synchronous opening/lifting mechanism according to a second embodiment of the invention. In this second embodiment, the storage box is adapted for receiving an object 5A, and is configured with a shell unit 1A, a storage unit 2A, a lifting unit 3A and a synchronization unit 4A.

Similar to the first embodiment, the shell unit 1A is configured with a first shell 10A and a second shell 11A; the storage unit 2A is disposed at a position between the first shell 10A and the second shell 11A and is also configured with a receiving frame 20A; and the lifting unit 3A is disposed at a position between the first shell 10A, the second shell 11A and the receiving frame 20A, and is also configured with a pulling part 30A and a supporting part 31A in a manner similar to those shown in the first embodiment.

In addition, the synchronization unit 4A is similarly disposed at a position between the first shell 10A, the second shell 11A and the receiving frame 20A, but is configured with a first synchronizing part 40A and a second synchronizing part 41A which is different from the first embodiment. The first synchronizing part 40A is coupled to the inner wall of the second shell 11A by an end thereof at a position closed to the second opening, while allowing another end thereof to wind around the bottom end of the receiving frame 20A and then coupled to an inner wall of the first shell 10A at a position close to the first opening, and the second synchronizing part 41A is coupled to the first shell 10A at a position close to the first opening by one end thereof while allowing another end thereof to wind around the bottom end of the receiving frame 20A and then coupled to an inner wall of the second shell 11A at a position close to the second opening.

As shown in FIG. 7, when the first shell 10A is enabled to move in a direction away from the second shell 11A, the first synchronizing part 40A will be brought along to move with the moving first shell 10A as it is coupled to the first shell 10A by one end thereof.

Simultaneously, since another end of the first synchronizing part 40A is coupled to the second shell 11A, the first synchronizing part 40A that is being brought along to move will pull and force the second shell 11A to move in a direction away from the first shell 10A, by that the shell unit 1A is opened.

When the shell unit 1A is opened, the pulling part 30A is being stretched for forcing the supporting part 31A to rise so as to position the object 5A that is placed at the top of the supporting part 31A to protrude out of the receiving frame 20A.

On the other hand, when the second shell 11A is enabled to move toward the first shell 10A, the second synchronizing part 41A will be brought along to move with the moving second shell 11A as it is coupled to the second shell 11A by one end thereof.

Simultaneously, since another end of the second synchronizing part 41A is coupled to the first shell 10A, the second synchronizing part 41A that is being brought along to move will pull and force the first shell 10A to move in a direction toward the second shell 11A, by that the shell unit 1A is closed.

When the shell unit 1A is closed, the pulling part 30A is relieved from being stretched for lowering the supporting part 31A so as to retract and receive the object 5A back into the receiving frame 20A.

Figure 8:
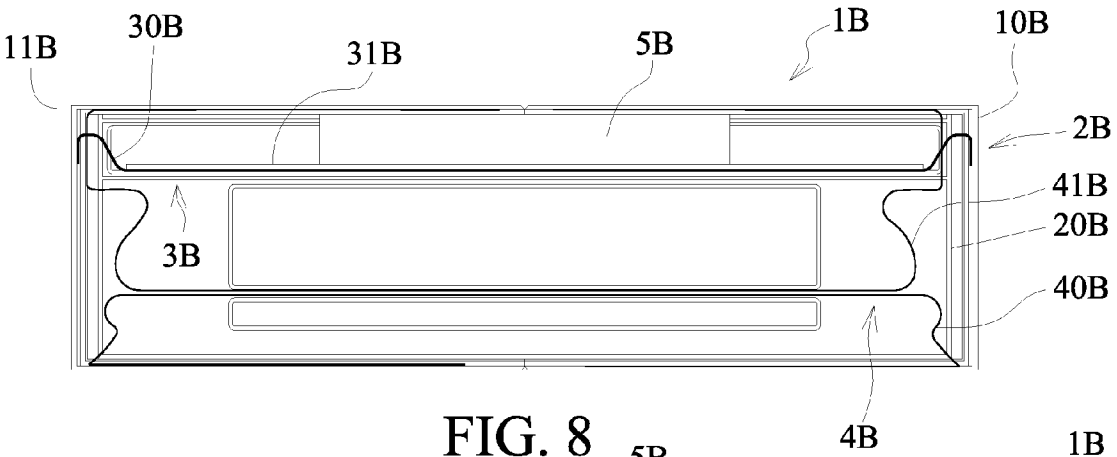
FIG. 8 is a cross-sectional view of a storage box with synchronous opening/lifting mechanism that is closed according to a third embodiment.
Figure 9:
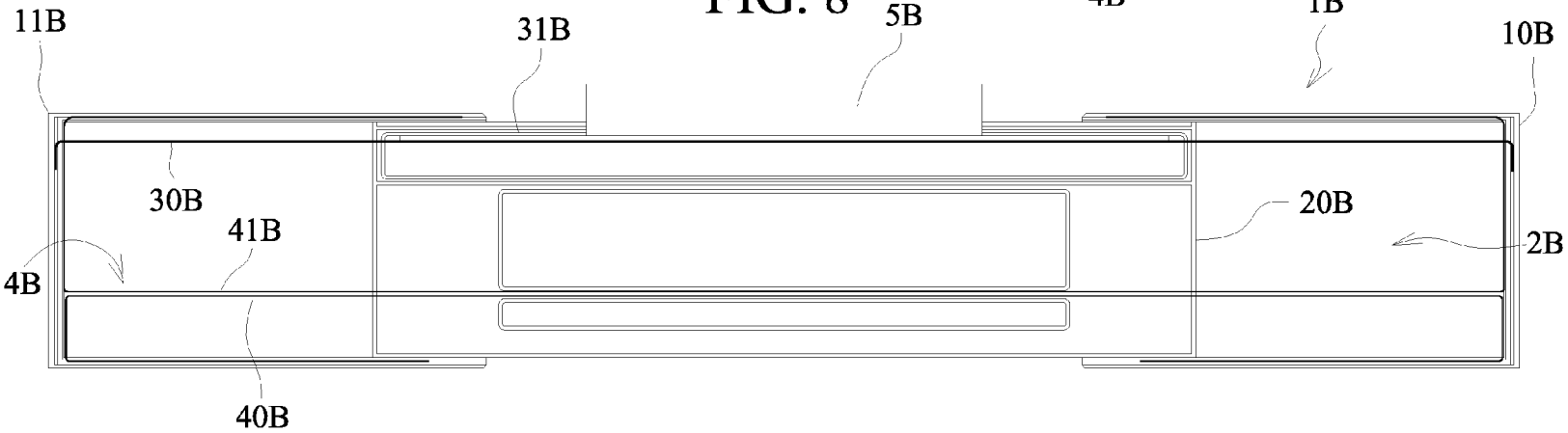
FIG. 9 is a three-dimensional view of a storage box of the third embodiment that is opened.

Please refer to FIG. 8 and FIG. 9, which are schematic diagrams showing a storage box with synchronous opening/lifting mechanism according to a third embodiment of the invention. In this third embodiment, the storage box is adapted for receiving an object 5B, and is configured with a shell unit 1B, a storage unit 2B, a lifting unit 3B and a synchronization unit 4B.

Similar to the first embodiment, the shell unit 1B is configured with a first shell 10B and a second shell 11B; the storage unit 2B is disposed at a position between the first shell 10B and the second shell 11B and is also configured with a receiving frame 20B; the lifting unit 3B is disposed at a position between the first shell 10B, the second shell 11B and the receiving frame 20B, and is also configured with a pulling part 30B and a supporting part 31B in a manner similar to those shown in the first embodiment; and the synchronization unit 4B is similarly disposed at a position between the first shell 10B, the second shell 11B and the receiving frame 20B, and is configured with a first synchronizing part 40B and a second synchronizing part 41B.

In addition, the first synchronizing part 40B is coupled to the bottom of an inner wall of the first shell 10B by one end thereof while allowing another end thereof to thread passing the receiving frame 20B and then coupled to the bottom of an inner wall of the second shell 11B, and the second synchronizing part 41B is coupled to the top of the inner wall of the first shell 10B by one end thereof while allowing another end thereof to thread passing the receiving frame 20B and then coupled to the top of the inner wall of the second shell 11B.

As shown in FIG. 9, when the first shell 10B is enabled to move in a direction away from the second shell 11B, the first synchronizing part 40B will be brought along to move with the moving first shell 10B as it is coupled to the first shell 10B by one end thereof.

Simultaneously, since another end of the first synchronizing part 40B is coupled to the second shell 11B, the first synchronizing part 40B that is being brought along to move will pull and force the second shell 11B to move in a direction away from the first shell 10B, by that the shell unit 1B is opened.

When the shell unit 1B is opened, the pulling part 30B is being stretched for forcing the supporting part 31B to rise so as to position the object 5B that is placed at the top of the supporting part 31B to protrude out of the receiving frame 20B.

On the other hand, when the second shell 11B is enabled to move toward the first shell 10B, the second synchronizing part 41B will be brought along to move with the moving second shell 11B as it is coupled to the second shell 11B by one end thereof.

Similarly, since another end of the second synchronizing part 41B is coupled to the first shell 10B, the second synchronizing part 41B that is being brought along to move will pull and force the first shell 10B to move in a direction toward the second shell 11B, by that the shell unit 1B is closed.

When the shell unit 1B is closed, the pulling part 30B is relieved from being stretched for lowering the supporting part 31B so as to retract and receive the object 5B back into the receiving frame 20B.

Figure 10:
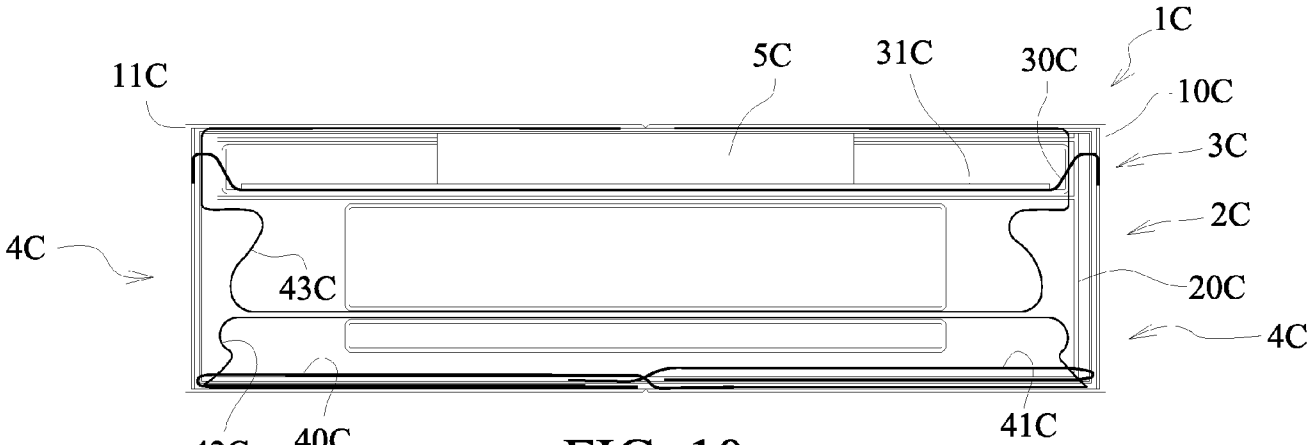
FIG. 10 is a cross-sectional view of a storage box with synchronous opening/lifting mechanism that is closed according to a fourth embodiment.
Figure 11:
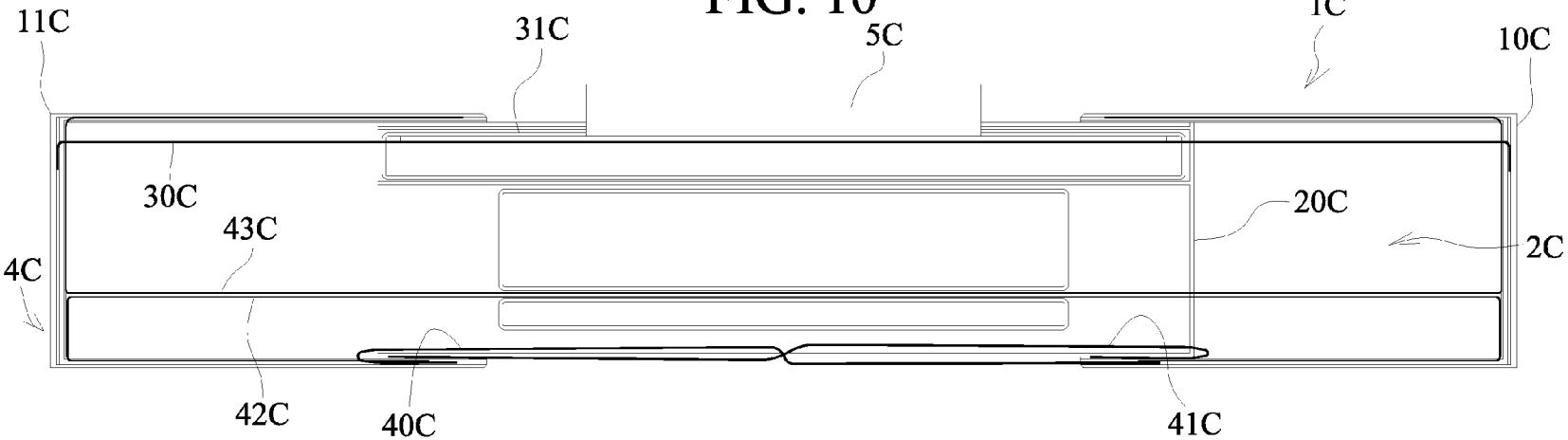
FIG. 11 is a three-dimensional view of a storage box of the fourth embodiment that is opened.

Please refer to FIG. 10 and FIG. 11, which are schematic diagrams showing a storage box with synchronous opening/lifting mechanism according to a fourth embodiment of the invention. In this third embodiment, the storage box is adapted for receiving an object 5C, and is configured with a shell unit 1C, a storage unit 2C, a lifting unit 3C and a synchronization unit 4C.

Similar to the first embodiment, the shell unit 1C is configured with a first shell 10C and a second shell 11C; the storage unit 2C is disposed at a position between the first shell 10C and the second shell 11C and is also configured with a receiving frame 20C; and the lifting unit 3C is disposed at a position between the first shell 10C, the second shell 11C and the receiving frame 20C, and is also configured with a pulling part 30C and a supporting part 31C in a manner similar to those shown in the first embodiment.

In addition, the synchronization unit 4C is similarly disposed at a position between the first shell 10C, the second shell 11C and the receiving frame 20C, but is configured with a first synchronizing part 40C, a second synchronizing part 41C, a third synchronizing part 42C and a fourth synchronizing part 43C, which is different from the first embodiment.

The first synchronizing part 40C is coupled to the inner wall of the second shell 11C by an end thereof at a position closed to the second opening, while allowing another end thereof to wind around the bottom end of the receiving frame 20C and then coupled to an inner wall of the first shell 10C at a position close to the first opening, and the second synchronizing part 41C is coupled to the first shell 10C at a position close to the first opening by one end thereof while allowing another end thereof to wind around the bottom end of the receiving frame 20C and then coupled to an inner wall of the second shell 11C at a position close to the second opening; the third synchronizing part 42C is coupled to the bottom of an inner wall of the first shell 10C by one end thereof while allowing another end thereof to thread passing the receiving frame 20C and then coupled to the bottom of an inner wall of the second shell 11C; and the fourth synchronizing part 43C is coupled to the top of the inner wall of the first shell 10C by one end thereof while allowing another end thereof to thread passing the receiving frame 20C and then coupled to the top of the inner wall of the second shell 11C.

Similar to the synchronization units described in the second and the third embodiments, the first synchronizing part 40C, the second synchronizing part 41C, the third synchronizing part 42C and the fourth synchronizing part 43C are used and operating cooperatively the same as the synchronization units. It is noted that each of the first synchronizing part 40C, the second synchronizing part 41C, the third synchronizing part 42C and the fourth synchronizing part 43C is a component selected from the group consisting of: a flexible rope and a flexible plate.

As shown in FIG. 11, when the first shell 10C is enabled to move in a direction away from the second shell 11C, the first synchronizing part 40C will be brought along to move with the moving first shell 10C as it is coupled to the first shell 10C by one end thereof, and similarly the third synchronizing part 42C will be brought along to move with the moving first shell 10C as it is also coupled to the first shell 10C by one end thereof.

Simultaneously, since another end of the first synchronizing part 40C as well as another end of the third synchronizing part 42C is coupled to the second shell 11C, the first synchronizing part 40C and the third synchronizing part 42C that are being brought along to move will pull and force the second shell 11C to move in a direction away from the first shell 10C, by that the shell unit 1C is opened.

When the shell unit 1C is opened, the pulling part 30C is being stretched for forcing the supporting part 31C to rise so as to position the object 5C that is placed at the top of the supporting part 31C to protrude out of the receiving frame 20C.

On the other hand, when the second shell 11C is enabled to move toward the first shell 10C, the second synchronizing part 41C as well as the fourth synchronizing part 43C will be brought along to move with the moving second shell 11C as both are coupled to the second shell 11C by one end thereof.

Similarly, since another end of the second synchronizing part 41C as well as another end of the fourth synchronizing part 43C are coupled to the first shell 10C, the second synchronizing part 41C and the fourth synchronizing part 43C that are being brought along to move will pull and force the first shell 10C to move in a direction toward the second shell 11C, by that the shell unit 1C is closed.

When the shell unit 1C is closed, the pulling part 30C is relieved from being stretched for lowering the supporting part 31C so as to retract and receive the object 5C back into the receiving frame 20C.

Figure 12:
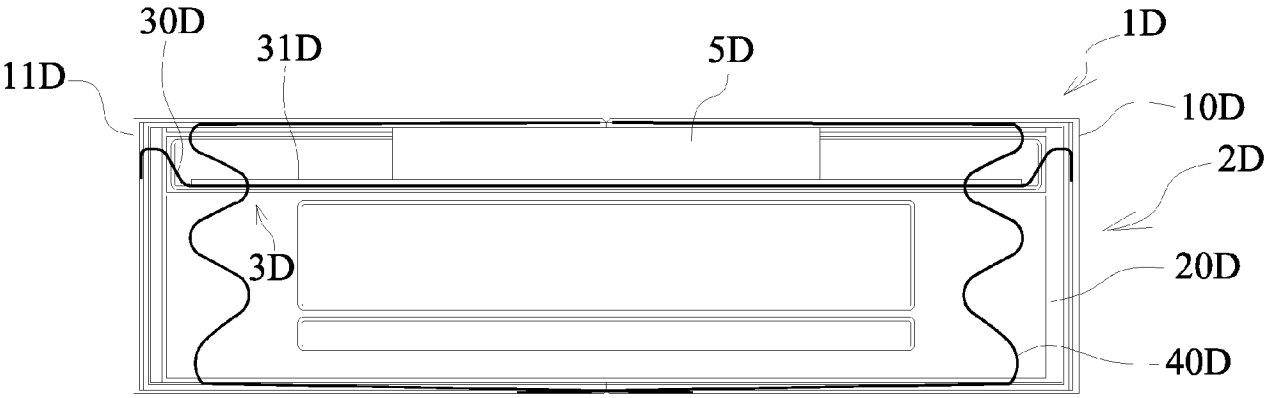
FIG. 12 is a cross-sectional view of a storage box with synchronous opening/lifting mechanism that is closed according to a fifth embodiment.
Figure 13:
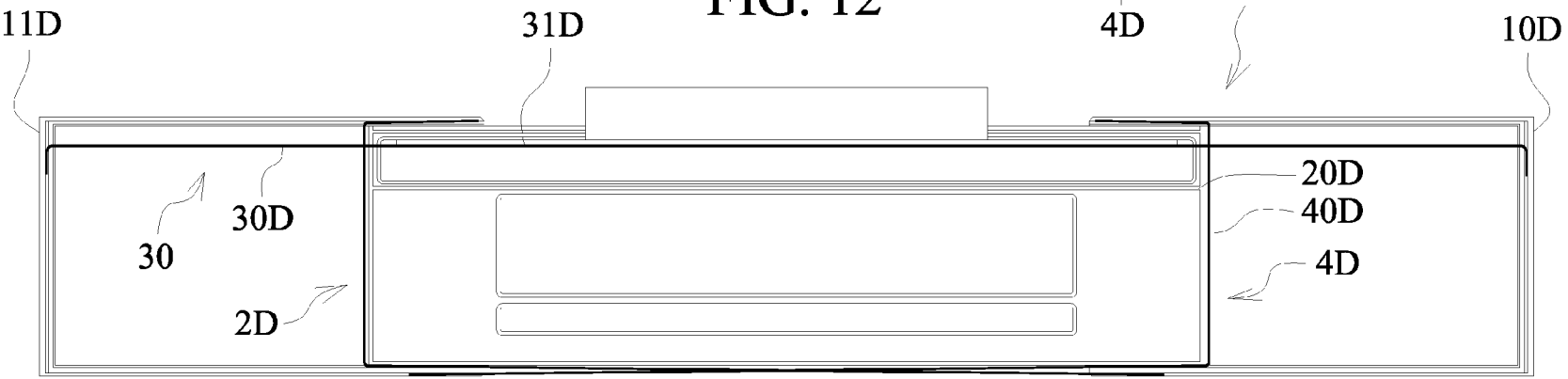
FIG. 13 is a three-dimensional view of a storage box of the fifth embodiment that is opened.

Please refer to FIG. 12 and FIG. 13, which are schematic diagrams showing a storage box with synchronous opening/lifting mechanism according to a fifth embodiment of the invention. In this third embodiment, the storage box is adapted for receiving an object 5D, and is configured with a shell unit 1D, a storage unit 2D, a lifting unit 3D and a synchronization unit 4D.

Similar to the first embodiment, the shell unit 1D is configured with a first shell 10D and a second shell 11D; the storage unit 2D is disposed at a position between the first shell 10D and the second shell 11D and is also configured with a receiving frame 20D; and the lifting unit 3D is disposed at a position between the first shell 10D, the second shell 11D and the receiving frame 20D, and is also configured with a pulling part 30D and a supporting part 31D in a manner similar to those shown in the first embodiment.

In addition, the synchronization unit 4D is similarly disposed at a position between the first shell 10D, the second shell 11D and the receiving frame 20D, but is configured with a first synchronizing part 40D, which is different from the first embodiment.

The first synchronizing part 40D is coupled to the inner wall of the first shell 10D by an end thereof at a position closed to the first opening, while allowing another end thereof to wind around the top end of the receiving frame 20D and then coupled to an inner wall of the second shell 11D at a position close to the second opening. Similarly, the first synchronizing part 40D is a component selected from the group consisting of: at least one flexible rope and a flexible plate.

As shown in FIG. 13, when the first shell 10D is enabled to move in a direction away from the second shell 11D, the first synchronizing part 40D will be brought along to move with the moving first shell 10D as it is coupled to the first shell 10D by one end thereof.

Simultaneously, since another end of the first synchronizing part 40D is coupled to the second shell 11D, the first synchronizing part 40D that is being brought along to move will pull and force the second shell 11D to move in a direction away from the first shell 10D, by that the shell unit 1D is opened.

When the shell unit 1D is opened, the pulling part 30D is being stretched for forcing the supporting part 31D to rise so as to position the object 5D that is placed at the top of the supporting part 31D to protrude out of the receiving frame 20D.

On the other hand, when the second shell 11D is enabled to move toward the first shell 10D, the first synchronizing part 40D will be brought along to move with the moving second shell 11D as it is coupled to the second shell 11D by one end thereof.

Similarly, since another end of the first synchronizing part 40D is coupled to the first shell 10D, the first synchronizing part 40D that is being brought along to move will pull and force the first shell 10D to move in a direction toward the second shell 11D, by that the shell unit 1D is closed.

When the shell unit 1D is closed, the pulling part 30D is relieved from being stretched for lowering the supporting part 31D so as to retract and receive the object 5D back into the receiving frame 20D.

To sum up, the present invention provides an improved storage box that is capable of utilizing a built-in lifting unit to enable an object received therein to rise with the opening of the box and to lower with the closing of the box, and thus is fun to operate. Moreover, the improved storage box is enabled to utilize a built-in synchronization unit to enable the first shell of the box to move in synchronization with the second shell in opposite directions toward each other or away from each other.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A storage box, comprising:

a shell unit, comprising:

a first shell, with a first opening; and a second shell, with a second opening at a position corresponding to the first opening;

a storage unit, inside the shell unit, for receiving an object, the storage unit comprising a receiving frame between the first shell and the second shell;

a lifting unit, disposed between the shell unit and the storage unit, configured to lift and lower the object; and a synchronization unit, disposed underneath the lifting unit and inside the shell unit and the storage unit, configured to synchronously open and close the shell unit, wherein the receiving frame has an inlet hole; the lifting unit is configured with a pulling part and a supporting part in a manner that one end of the pulling part is coupled to an inner wall of the first shell while allowing another end thereof to thread passing through the receiving frame to be coupled to an inner wall of the second shell, and the supporting part is disposed inside the receiving frame at a position corresponding to the inlet hole while coupling to the pulling part.

2. The storage box of claim 1, wherein the storage unit further comprises a drawer at a bottom of the receiving frame.

3. The storage box of claim 1, wherein the pulling part is composed of at least two flexible ropes or is substantially a flexible plate.

4. The storage box of claim 1, wherein the synchronization unit is further configured with a guiding part and a synchronizing part in a manner that the guiding part is arranged at a position between the first shell and the receiving frame, and the synchronizing part is coupled to the first shell at a position close to the first opening by one end thereof while allowing another end thereof to circle around the guiding part and then coupled to an inner wall of the second shell.

5. The storage box of claim 4, wherein the guiding part is a component selected from the group consisting of: a rod, a plate, and a pillar; and the synchronizing part is a component selected from the group consisting of: a flexible rope and a flexible plate.

6. The storage box of claim 1, wherein the synchronization unit is further configured with a first synchronizing part and a second synchronizing part in a manner that the first synchronizing part is coupled to the second shell at a position close to the second opening by one end thereof while allowing another end thereof to wind around the bottom end of the receiving frame and then coupled to an inner wall of the first shell at a position close to the first opening, and the second synchronizing part is coupled to the first shell at a position close to the first opening by one end thereof while allowing another end thereof to wind around the bottom end of the receiving frame and then coupled to an inner wall of the second shell at a position close to the second opening.

7. The storage box of claim 6, wherein the synchronization unit is further configured with a third synchronizing part and a fourth synchronizing part in a manner that the third synchronizing part is coupled to the bottom of an inner wall of the first shell by one end thereof while allowing another end thereof to thread passing the receiving frame and then coupled to the bottom of an inner wall of the second shell, and the fourth synchronizing part is coupled to the top of the inner wall of the first shell by one end thereof while allowing another end thereof to thread passing the receiving frame and then coupled to the top of the inner wall of the second shell.

8. The storage box of claim 7, wherein each of the first synchronizing part, the second synchronizing part, the third synchronizing part and the fourth synchronizing part is a component selected from the group consisting of: a flexible rope and a flexible plate.

9. The storage box of claim 1, wherein the synchronization unit is further configured with a first synchronizing part and a second synchronizing part in a manner that the first synchronizing part is coupled to the bottom of an inner wall of the first shell by one end thereof while allowing another end thereof to thread passing the receiving frame and then coupled to the bottom of an inner wall of the second shell, and the second synchronizing part is coupled to the top of the inner wall of the first shell by one end thereof while allowing another end thereof to thread passing the receiving frame and then coupled to the top of the inner wall of the second shell.

10. The storage box of claim 9, wherein each of the first synchronizing part and the second synchronizing part is a component selected from the group consisting of: a flexible rope and a flexible plate.

11. The storage box of claim 1, wherein the synchronization unit is further configured with a first synchronizing part in a manner that the first synchronizing part is coupled to an inner wall of the first shell by one end thereof while allowing another end thereof to wind around the top of the receiving frame and then coupled to an inner wall of the second shell.

12. The storage box of claim 11, wherein the first synchronizing part is a component selected from the group consisting of: a flexible rope and a flexible plate.

13. The storage box of claim 1, wherein the shell unit comprises a first shell and a second shell, and the lifting unit comprises a pulling part comprising two flexible ropes connected to the storage unit, wherein one end of the pulling part is coupled to an inner wall of the first shell and another end of the pulling part is coupled to an inner wall of the second shell.

* * * * *